US006531689B2

(12) United States Patent
Ohishi et al.

(10) Patent No.: US 6,531,689 B2
(45) Date of Patent: Mar. 11, 2003

(54) FIXING DEVICE USING AN INVERTER CIRCUIT FOR INDUCTION HEATING

(75) Inventors: Hiroto Ohishi, Kanagawa (JP); Jiro Oouchi, Miyagi (JP)

(73) Assignees: Ricoh Company, Ltd., Tokyo (JP); Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/852,700

(22) Filed: May 11, 2001

(65) Prior Publication Data

US 2002/0003139 A1 Jan. 10, 2002

(30) Foreign Application Priority Data

May 12, 2000 (JP) ..... 2000-140312

(51) Int. Cl.[7] ..... H05B 6/06

(52) U.S. Cl. ..... 219/661; 219/619; 219/665; 399/328; 399/335; 363/97

(58) Field of Search ..... 219/619, 660, 219/661, 662, 663, 665, 216; 399/328, 330, 335, 336; 363/21, 97

(56) References Cited

U.S. PATENT DOCUMENTS 6,018,154 A * 1/2000 Izaki et al. ..... 219/645

6,246,843 B1 * 6/2001 Nanataki et al. ..... 399/334

FOREIGN PATENT DOCUMENTS

JP 2000-259018 9/2000

* cited by examiner

*Primary Examiner*—Philip H. Leung

(74) *Attorney, Agent, or Firm*—Oblon, Spivak, McClelland, Maier & Neustadt, P.C.

(57) ABSTRACT

A fixing device for an image forming apparatus includes an inverter circuit for induction heating. In the inverter circuit, a main switch Q1 drives one end of a work coil L1 whose other end is connected to a power source. A serial connection of a capacitor Cs and a subswitch Q2 is connected to opposite ends of the coil L1 in parallel such that one end of the capacitor Cs is connected to the power source E. A second capacitor C1 is connected to the subswitch Q2 in parallel. For a capacitance of 0.1 $\mu$F of the capacitor C1, the factor of the coil L1 and that of the capacitor Cs are selected to be between 70 $\mu$H and 100 $\mu$H and between 1.8 $\mu$F and 5 $\mu$F, respectively. The inverter circuit is operable with optimal efficiency in the event of PWM (Pulse Width Modulation) control using a fixed frequency.

4 Claims, 11 Drawing Sheets

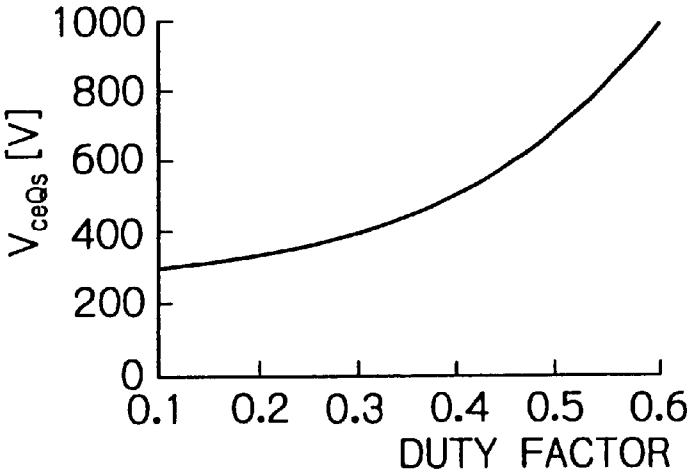
Fig. 4B
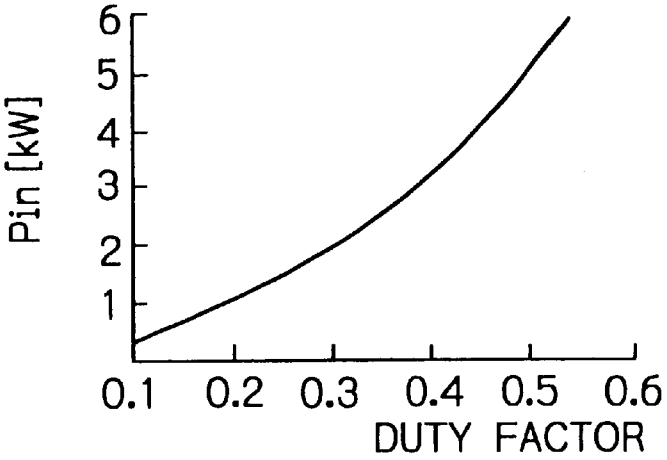
Fig. 4A PREOR ART
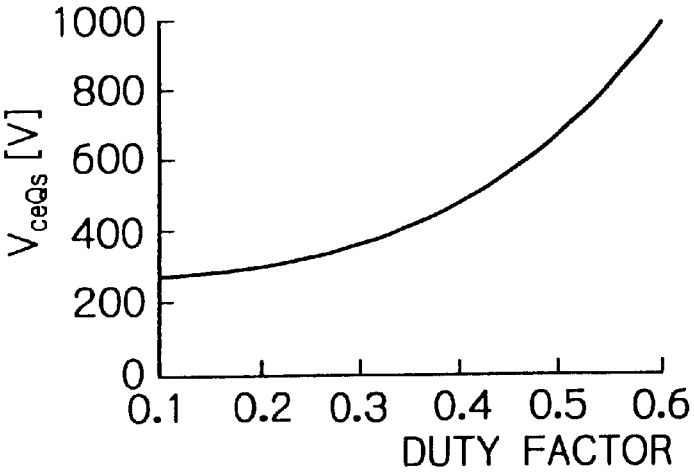
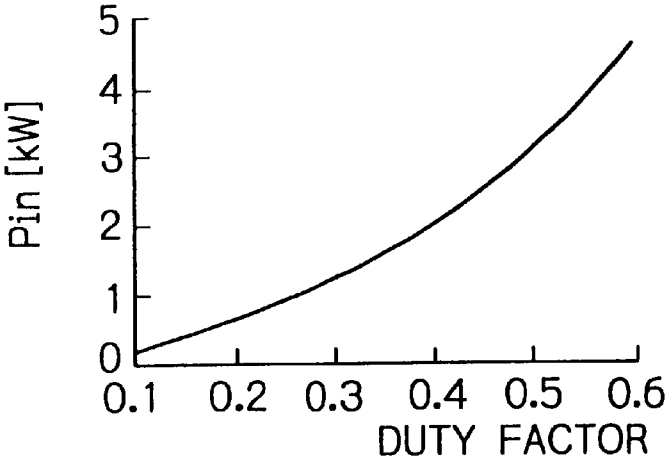

FIXING DEVICE USING AN INVERTER CIRCUIT FOR INDUCTION HEATING

BACKGROUND OF THE INVENTION

The present invention relates to a fixing device for a copier, printer, facsimile apparatus or similar image forming apparatus and more particularly to an induction heating type of fixing device.

An induction heating type of fixing device for use in an image forming apparatus is configured to heat the wall or core of a heat roller with Joule heat derived from induced current. Specifically, this type of fixing device includes electromagnetic induction heating means having an induction heating coil. High frequency current is fed to the induction heating coil to cause it to generate an induced flux, which in turn generates induced current (eddy current) in a conductive layer covering the heat roller. Joule heat derived from the induced current heats the surface of the heat roller to a preselected temperature. It is a common practice to produce the high frequency current by rectifying AC available with a commercial power source with a rectifying circuit and then converting it to high frequency.

A conventional inverter circuit for induction heating stabilizes the fixing temperature of the fixing device by varying frequency. A problem with this conventional scheme is that the varying frequency translates into the variation of the penetration depth of the eddy current and thereby prevents power for maintaining optimal fixing temperature from being input to the heat roller. Further, the variation of the penetration depth of the eddy current causes the heat distribution on the surface of the heat roller to vary, effecting the quality of a fixed image.

When the inverter circuit is configured for an AC 200 V application, it needs a switching device that withstands voltage two times as high as the withstanding voltage of a switching device for an AC 100 V application. A switching device for an AC 200 V application and comparable in size with a switching device for an AC 100 V application is rare or is insufficient in withstanding voltage if available. While a mold type switching device withstands high voltage, it is packaged in a size more than two times as great as the size of a 100 V switching device. This kind of switching device is not applicable to a high frequency inverter for use in a fixing device. It has therefore been difficult to realize a miniature inverter circuit adaptive to a 200 V application.

Moreover, a power control range available with the conventional inverter circuit is narrow. Therefore, when the load of the inverter circuit is light, current flowing through the induction heating coil or work coil is short and prevents current from being fully discharged from a resonance capacitor. It follows that the inverter circuit fails to perform zero voltage switching and looses its high efficiency and low noise features based on zero voltage switching.

Technologies relating to the present invention are disclosed in, e.g., Japanese Patent Laid-Open Publication No. 9-245953 and 2000-259018.

SUMMARY OF THE INVENTION

It is an object of the present invention to provide a fixing device using an inverter circuit for induction heating that achieves high efficiency and reduces the stress of a switching device as well as switching noise. In accordance with the present invention, an inverter circuit for induction heating includes a switching device that drives one end of an induction heating coil the other end of which is connected to a power source. A capacitor and a second switching device are serially connected to each other and connected to opposite ends of the induction heating coil in parallel such that one end of the capacitor is connected to the power source. A second capacitor is connected to the second switching device in parallel. The second capacitor has a capacitance of 0.1 $\mu$F to 0.4 $\mu$F. For a capacitance of 0.1 $\mu$F of the second capacitor, the induction heating coil has an inductance of 70 $\mu$H to 100 $\mu$H while the capacitor has a capacitance of 1.8 $\mu$F to 5 $\mu$F. Also, for a capacitance of 0.2 $\mu$F of the second capacitor, the induction heating coil has an inductance of 65 $\mu$H to 100 $\mu$H while the capacitor has a capacitance of 1.8 $\mu$F to 5 $\mu$F. Further, for a capacitance of 0.3 $\mu$F of the second capacitor, the induction heating coil has an inductance of 65 $\mu$H to 95 $\mu$H while the capacitor has a capacitance of 2 F to 5 F. Moreover, for a capacitance of 0.4 $\mu$F of the second capacitor, the induction heating coil has an inductance of 65 $\mu$H to 87 $\mu$H while the capacitor has a capacitance of 2.3 $\mu$F to 5 $\mu$F.

BRIEF DESCRIPTION OF THE DRAWINGS

The above and other objects, features and advantages of the present invention will become more apparent from the following detailed description taken with the accompanying drawings in which:

FIG. 4A shows graphs representative of an input power control characteristic particular to a prior art conventional inverter circuit;

FIG. 4B shows graphs representative of an input power control characteristic achievable with the illustrative embodiment;

DESCRIPTION OF THE PREFERRED EMBODIMENTS

Figure 1:
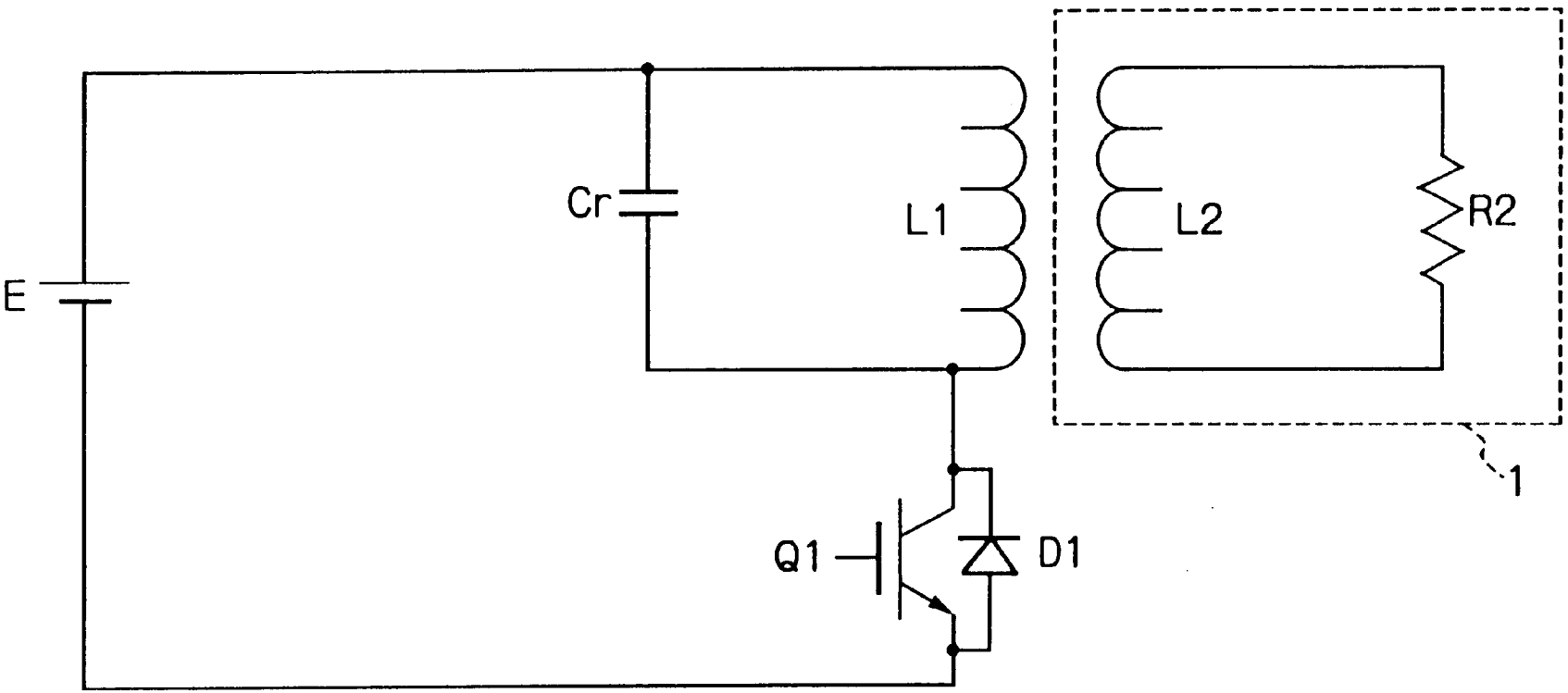
Fig. 1 PRIOR ART
FIG. 1 is a circuit diagram showing a conventional inverter circuit for induction heating included in a fixing device.

To better understand the present invention, brief reference will be made to a conventional inverter circuit for induction heating included in a fixing device and configured for a 100 V application. As shown in FIG. 1, the inverter circuit includes a work coil or induction heating coil L1, a switching device Q1, and a capacitor Cr. A power source E is representative of a DC power source produced by rectifying a commercial power source. A coil L2 and a resistor R2, which are surrounded by a dashed line, are representative of a circuit electrically equivalent to a heat roller 1. The switching device Q1 is usually implemented by an IGBT (Insulated Gate Bipolar model Transistor) from the withstanding voltage and current capacity standpoint. Labeled D1 is a parasitic diode particular to the IGBT.

In operation, the switching device Q1 is driven by a high frequency in order to cause a high frequency current to flow through the work coil L1. As a result, an eddy current flows through the heat roller 1, i.e., the coil L2 and resistor R2, heating the heat roller 1. The width of a pulse that turns on the switching device Q1 is variable, so that necessary power can be fed. On the other hand, when the switching device Q1 is turned off, a flyback voltage appears on the collector of the switching device Q1. The flyback voltage is the resonance voltage of the work coil L1 and capacitor Cr. Therefore, although zero voltage switching is achievable, the duration of turn-off of the switching device Q1 is determined by the time constant of the work coil L1 and capacitor Cr and is not variable. Consequently, the heat roller 1 cannot be controlled to optimal temperature for fixation unless the frequency of the switching device Q1 is varied. This brings about the problems discussed earlier.

Figure 2:
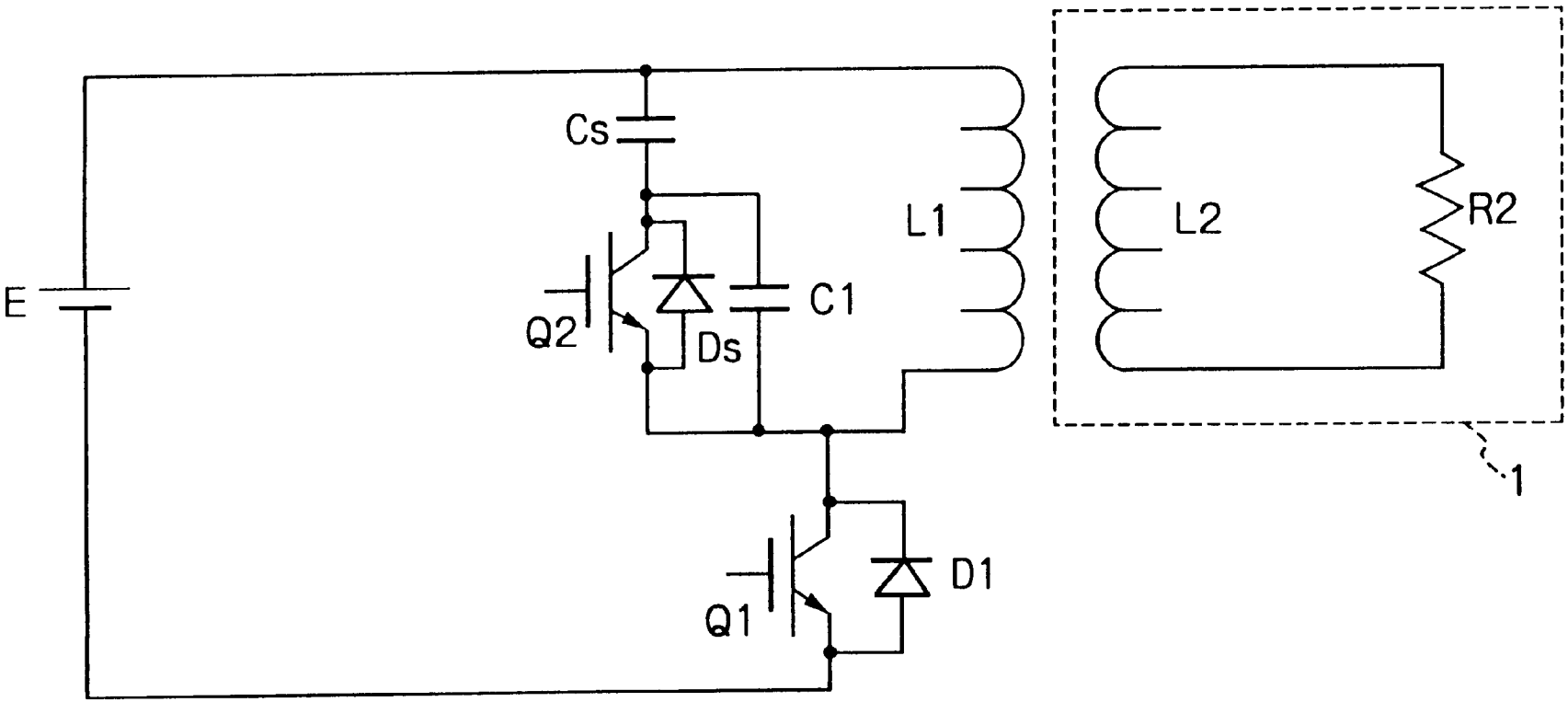
FIG. 2 is a circuit diagram showing an inverter circuit for a fixing device embodying the present invention.

Referring to FIG. 2, a fixing device with an inverter circuit for induction heating embodying the present invention is shown. In FIG. 2, symbols identical with the symbols of FIG. 1 designate identical structural elements. As shown, the inverter circuit includes an additional capacitor Cs and a second switching device Q2 (IGBT) connected to a work coil L1 in parallel. A second capacitor C1 is connected to the switching device Q2 in parallel from the junction of the serial connection of the capacitor Cs and switching device Q2. Labeled Ds is a parasitic diode particular to the switching device Q2.

In the illustrative embodiment, the switching device Q1 plays the role of a main switch. The capacitors C1 and Cs are a first and a second resonance capacitor, respectively. The switching device Q2 serves as a subswitch while the diode Ds is a reverse conducting diode associated with the subswitch Q2.

Figure 3A:
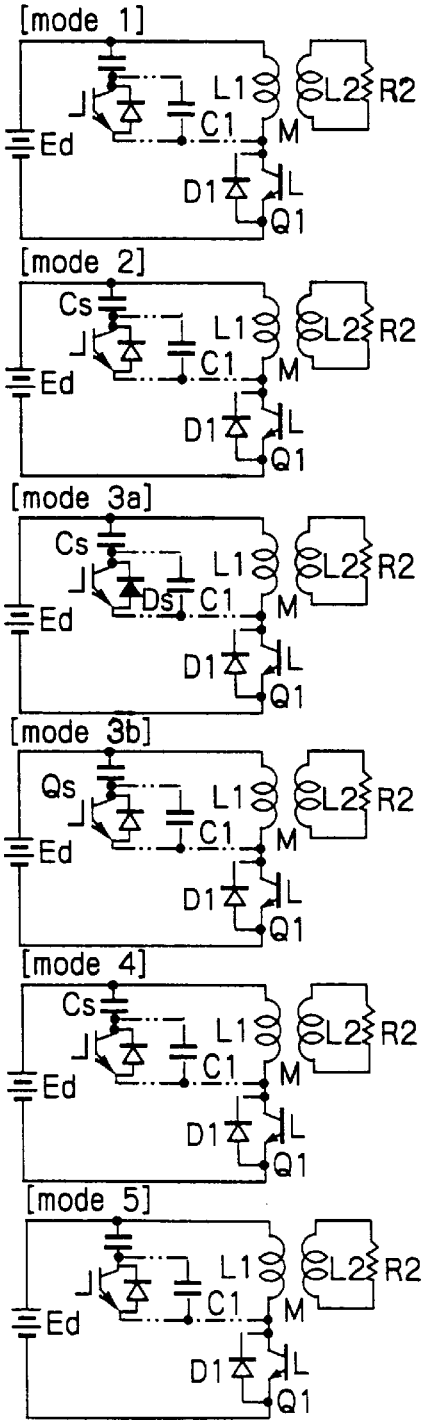
FIG. 3A demonstrates mode transition unique to the illustrative embodiment.
Figure 3B:
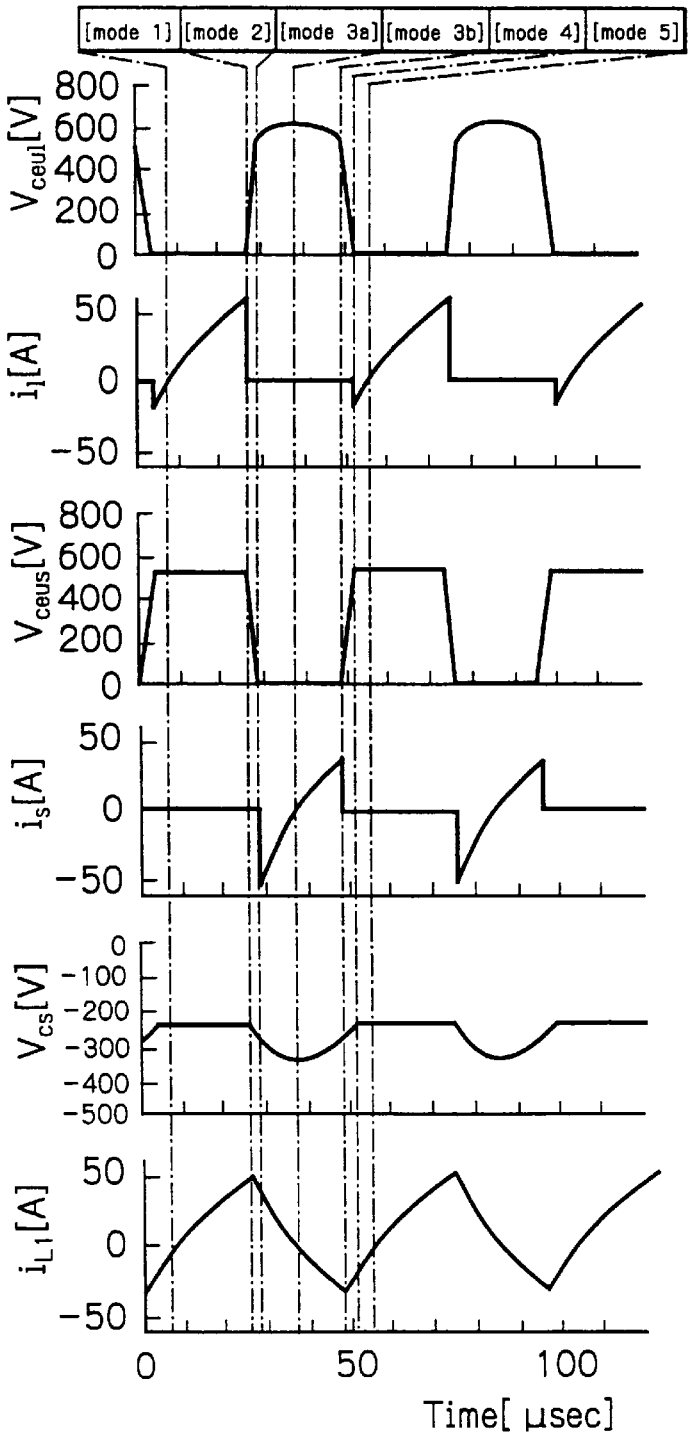
FIG. 3B shows waveforms associated with the mode transition of FIG. 3A.

The principle of operation of the illustrative embodiment will be described hereinafter with reference to FIGS. 3A and 3B. FIGS. 3A shows the transition of consecutive modes 1 through 5 that the illustrative embodiment repeats at a preselected period. FIG. 3B shows waveforms respectively representative of a voltage between the collector and the emitter of the main switch Q1, a current flowing through the main switch Q1, a voltage between the collector and the emitter of the subswitch Q2 (Qs), a current flowing through the subswitch Q2, a voltage stored in the second resonance capacitor Cs, and a current flowing through the work coil L1, as named from the top to the bottom.

In the mode 1, which is a power consumption and non-resonance mode, the main switch Q1 turns on at a time t0 to store energy in the work coil L while feeding power to the load that generates heat, i.e., the work coil L1, coil L2, and resistor R2.

In the mode 2, which is a power consumption and partial resonance mode, the main switch Q1 turns off at a time t1. As a result, a closed loop including the load made up of the work coil L1, coil L2 and resistor R2, first resonance capacitor C1 and second resonance capacitor Cs is activated to set up a partial resonance mode. During this period of time, the capacitors C1 and Cs are charged and discharged so as to reduce the value dv/dt of the main switch Q1. The main switch Q1 can therefore turn off by ZVS (Zero Voltage Switching).

The mode 3*a* is a power consumption and diode Ds conduction, resonance mode. In this mode, when the voltage of the first resonance capacitor C1 becomes zero, the reverse conducting diode Ds of the subswitch Q2 (Qs) turns on. As a result, a closed loop including the load made up of the work coil L1, coil L2 and resistor R2, second resonance capacitor Cs and diode Ds is activated.

The mode 3*b* following the mode 3*a* is a power consumption and subswitch Q2 conduction, resonance mode. In this mode, The current flowing through the subswitch Q2 becomes zero at a time t3. The subswitch Q2 therefore successfully turns on by ZVS and ZCS (Zero Current Switching). By maintaining the subswitch Q2 turned on during one period of the inverter, it is possible to allow the main switch Q1 to operate with a constant frequency even if the duration of conduction of the main switch Q1 is made variable.

In the mode 4, which is a power consumption and partial resonance mode, the subswitch Q2 turns off at a time t4. At this time, a closed loop including the load, i.e., the work coil L1, coil L2 and resistor R2, first resonance capacitor C1 and second resonance capacitor Cs is activated to set up a partial resonance mode. By charging and discharging the capacitor C1 and Cs during this period of time, it is possible to reduce the value dv/dt of the subswitch Q2 and therefore to implement turn-off by ZVS.

In the mode 5, which is a power regeneration and non-resonance mode, the sum of the voltage of the first resonance capacitor C1 and that of the second resonance capacitor Cs tends to increase above the power source voltage Ed at a time t5. At this instant, the reverse conducting diode D1 is biased forward and sets up the mode 5. The current flowing through the main switch Q1 becomes zero at the time t0 and again sets up the mode 1. At this time, the main switch Q1 turns on by ZVS and ZCS.

The modes 1 through 5 are repeated at a preselected period, as stated above. The additional switching device Q2 and capacitors Cs and C1 allow the duration of turn-off to be variable and therefore realizes power control based on PWM (Pulse Width Modulation), which uses fixed frequency. It is therefore possible to maintain the penetration depth of eddy current in the heat roller constant. This insures stable fixation than enhances image quality.

One of major advantages achievable with the illustrative embodiment will be described hereinafter. The subswitch Q2 and second resonance capacitor Cs lower voltage at the time of turn-off and therefore lower voltage to act on the main switch Q1 and subswitch Q2. It follows that the illustrative embodiment is practicable with devices for 100 V applications and therefore realizes a miniature inverter circuit. This implements a miniature fixing device adaptive to an AC 200 V power source system.

Japanese Patent Laid-Open Publication No. 9-245953 mentioned earlier teaches a circuit similar to the circuit of FIG. 2 and in which the capacitor C1 and work coil L1 of the illustrative embodiment are connected in parallel. FIGS. 4A and 4B compare the prior art circuit of the above document and the illustrative embodiment as to the voltage to act on the subswitch Q2 determined by simulation. For the simulation, an input voltage was assumed to be 280 V. Specifically, FIGS. 4A and 4B pertain to the prior art circuit and illustrative embodiment, respectively. FIGS. 4A and 4B each sow the peak VceQs of the voltage acting on the subswitch Q2 in accordance with a pulse width (Duty Factor) that varies in accordance with the input voltage Pin.

As shown in FIG. 4A, for input power Pin of 3 kW, the duty of the prior art circuit is 0.48 while a peak voltage VceQs corresponding to such a duty is about 660 V. By contrast, as shown in FIG. 4B, the duty of the illustrative embodiment is 0.375 for the input power Pin of 3 kW; a peak voltage corresponding to the duty of 0.375 is as low as 490 V. The peak voltage of 490 V is lower than the peak voltage of 660 V by 170 V. The illustrative embodiment is therefore operable with an input voltage and a voltage range impractical with the prior art circuit. This is because the maximum withstanding voltage of switching devices is generally 900 V or so.

Another major advantage of the illustrative embodiment is that the switching devices Q1 and Q2 each turn on and turn off when voltage and current both are zero, realizing ZVS and ZCS. The switching devices Q1 and Q2 therefore involve a minimum of switching loss, making the inverter circuit efficient and free from noticeable switching noise.

The illustrative embodiment differs from the embodiment shown in FIG. 2 in that the positional relation between the work coil portion and the switching device Q1 is inverted in the up-and-down direction. While the illustrative embodiment operates in the same manner as the embodiment of FIG. 2, it is characterized in that one end of the work coil L1 is connected to ground.

Figure 5:
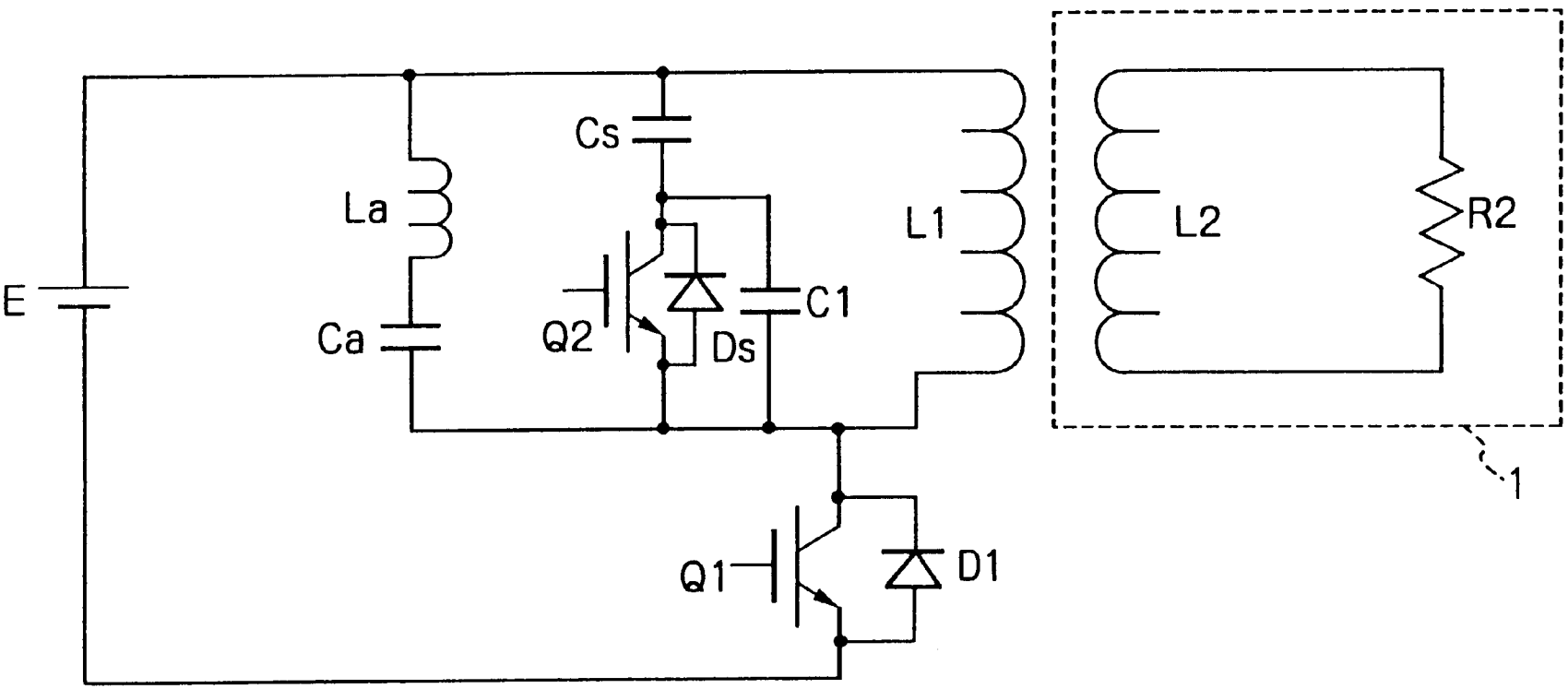
FIG. 5 is a circuit diagram showing an alternative embodiment of the present invention.

Reference will be made to FIG. 5 for describing an alternative embodiment of the present invention. In FIG. 5, symbols identical with the symbols of FIG. 2 designate identical structural elements. As shown, this embodiment is identical with the embodiment of FIG. 2 except that it additionally includes an inductor La and a capacitor Ca connected to the work coil L1 in parallel. The circuit of FIG. 5 operates in the same manner as the circuit of FIG. 2 except that a current fed to the inductance L1 partly flows to the inductor La. While the capacitor Ca is shown in FIG. 4 as being serially connected to the inductor La, the capacitor Ca may be omitted if the omission does not effect the operation of the inverter circuit.

In the previous embodiment shown in FIG. 2, the range that implements ZVS is, in principle, dependent on whether or not the first capacitor C1 (resonance capacitor Cr in the prior art circuit, FIG. 1) can be fully charged and discharged. More specifically, the above range is dependent on the value of resonance initial current that flows through, e.g., the work coil just before the partial resonance mode. In this case, the work coil is representative of the inductance of the closed loop formed in the partial resonance mode. It follows that when voltage is lowered in the circuits shown in FIGS. 1 and 2, the initial current value (magnetic energy) stored in the work coil L1 becomes short and makes ZVS impracticable.

In light of the above, the illustrative embodiment causes the inductor La serially connected to the work coil L1 to increase the resonance initial current value, thereby broadening the ZVS range.

Figure 6:
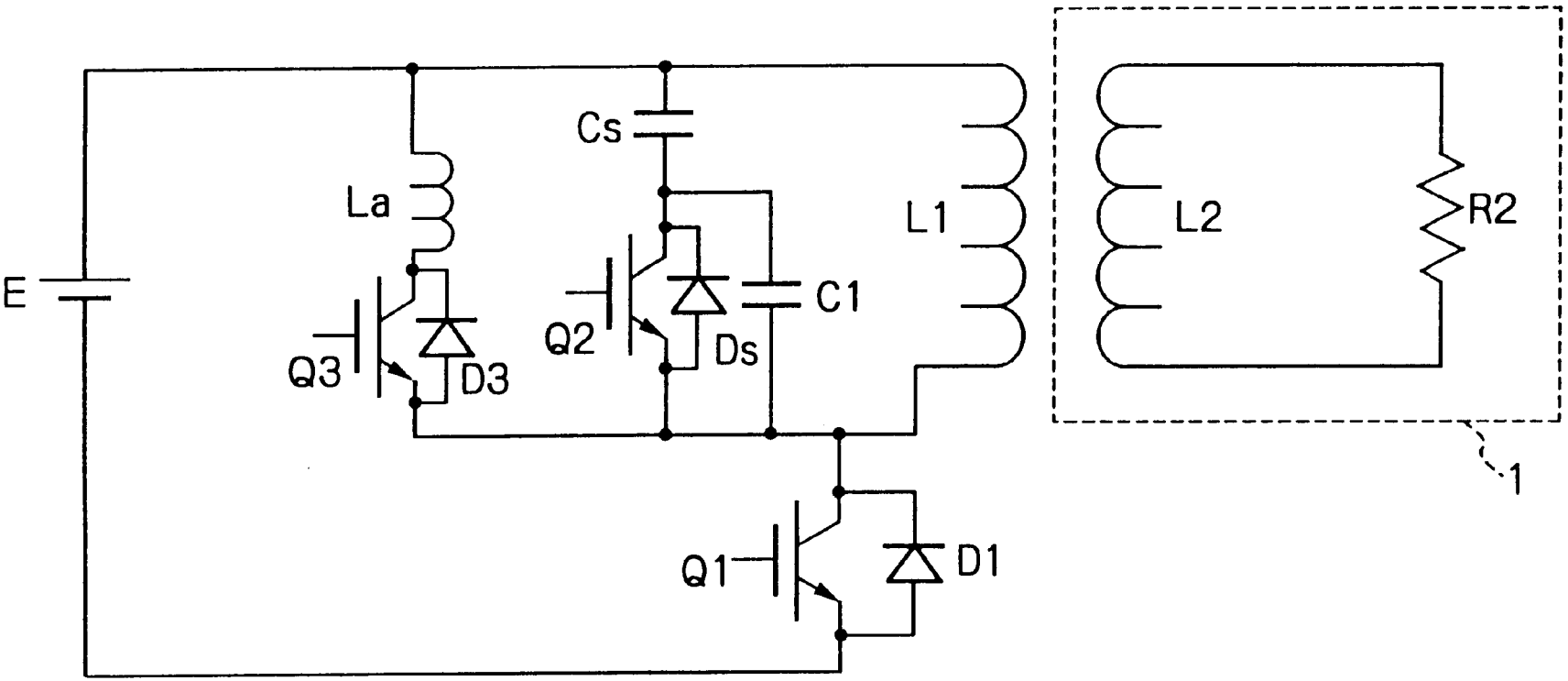
FIG. 6 is a circuit diagram showing another alternative embodiment of the present invention.

FIG. 6 shows another alternative embodiment of the present invention. In FIG. 6, symbols identical with the symbols of FIGS. 2 and 5 designate identical structural elements. As shown, in the illustrative embodiment, the inductor La and a third switching device Q3 are serially connected to each other and connected to the work coil L1 in parallel. As for the rest of the configuration, the illustrative embodiment is identical with the embodiment shown in FIG. 2. The illustrative embodiment differs from the embodiment shown in FIG. 5 in that the third switching device Q3 is substituted for the capacitor Ca. A diode D3 is associated with the switching device Q3.

The illustrative embodiment causes the third switching device Q3 to turn on only in a light load condition or in an operating condition not lying in the ZVS range. The illustrative embodiment may also include the capacitor Ca, FIG. 5, and serially connect it to the third switching device Q3, if desired. Because the third switching device Q3 turns on only in the above particular condition, the illustrative embodiment enhances efficiency while preserving the broader control range.

Figure 7:
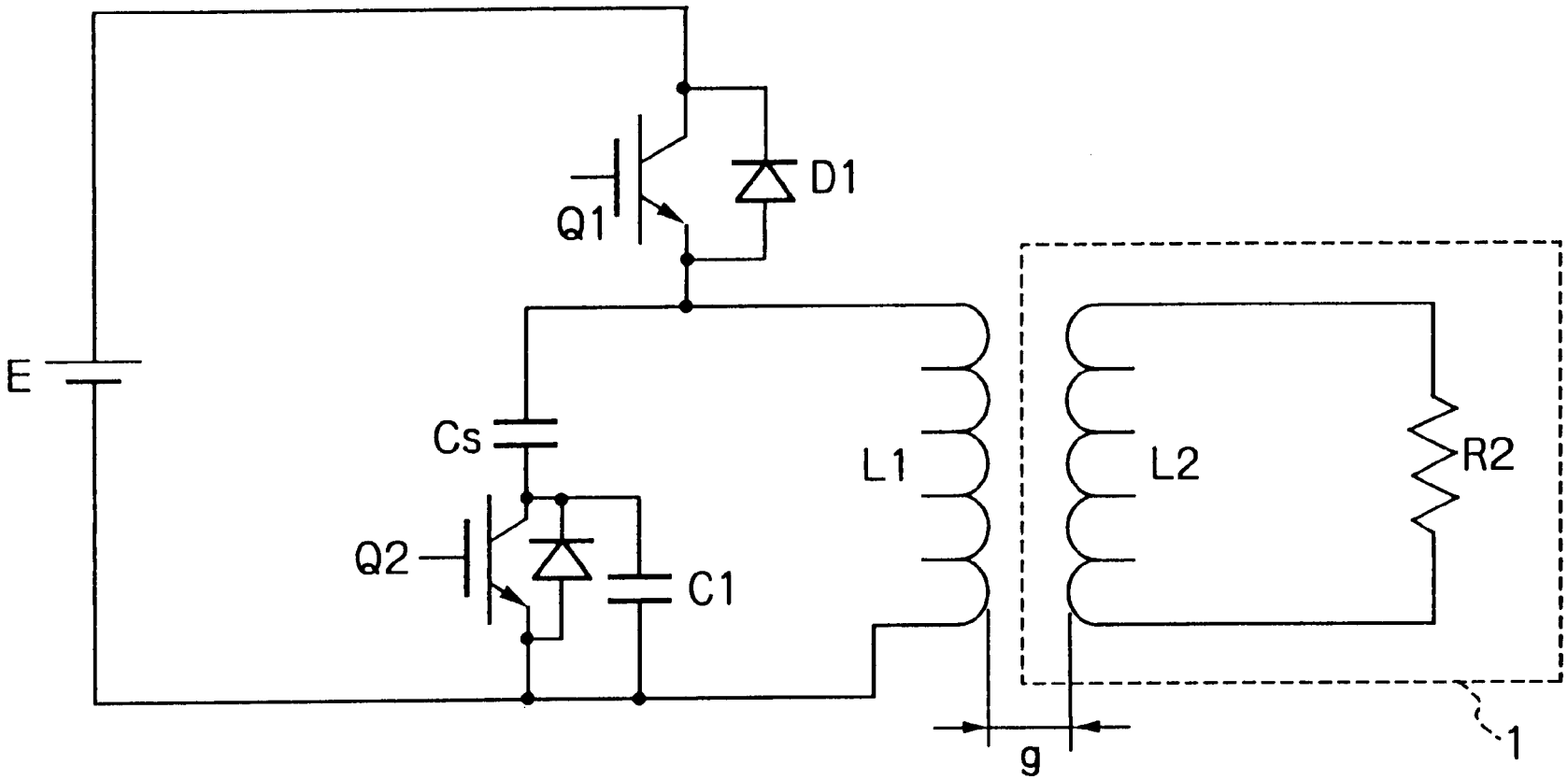
FIG. 7 is a circuit diagram showing a further alternative embodiment of the present invention.

A further alternative embodiment of the present invention of the present invention will be described with reference to FIG. 7. In FIG. 7, symbols identical with the symbols of FIG. 2 designate identical structural elements. As shown, in the illustrative embodiment, one end of the work coil L1 is connected to ground. The switching device Q1 serially connected to the work coil L1 is connected to the positive terminal of the power source E. The capacitor Cs and switching device Q2 serially connected to each other are connected to the work coil L1 in parallel. The capacitor C1 is connected to the switching device Q2 in parallel from the junction of the serial connection of the capacitor Cs and switching device Q2. The parasitic diode Ds is associated with the switching device Q2. Further, the heat roller 1, which is the load of the work coil L1, and the work coil L1 are spaced by a gap g of 3 mm or less.

The illustrative embodiment differs from the embodiment shown in FIG. 2 except that the positional relation between the work coil portion and the switching device Q1 is inverted in the up-and-down direction. While the illustrative embodiment operates in the same manner as the embodiment of FIG. 2, it is characterized in that one end of the work coil L1 is connected to ground.

In the circuit shown in FIG. 2, not only the high-frequency voltage driven by the switching device Q1 but also the power source voltage constantly act on the work coil L1, increasing the total voltage to act on the work coil L1. By contrast, in the illustrative embodiment, the voltage acting on the work coil L1 is lower than the above voltage by the power source voltage.

Generally, in an induction heating type fixing device, a hollow cylindrical heat roller concentrically surrounds a work coil or induction heating coil. The heat roller, which is the load of the work coil, is conductive and connected to ground. Therefore, when a power source voltage acts on the work coil, as in the embodiment shown in FIG. 2, high voltage acts on the work coil. It follows that the work coil and heat roller cannot be brought excessively close to each other from the safety or breakdown voltage standpoint. By contrast, the illustrative embodiment allows the gap between the work coil L1 and the heat roller 1 to be reduced because of the lower voltage to act on the work coil L1. More specifically, in the illustrative embodiment, the gap g between the work coil L1 and the heat roller 1 is selected to be 3 mm for realizing an efficient fixing device.

Further, because one end of the work coil L1 is connected to ground, the circuit elements connected to the work coil L1 are also connected to ground. The illustrative embodiment therefore reduces high frequency noise more than the embodiment shown in FIG. 1.

In each of the embodiments shown in FIGS. 2 and 5 through 7, the switching device Q1 repeats switching, as described with reference to FIG. 3B. If the switching voltage VcdQ1 and current i1 exceed the withstanding current and withstanding voltage of the switching device Q1, then the switching device Q1 breaks. It is therefore necessary to select the values of the first and second resonance capacitors C1 and Cs and the value of the inductance L1 of the work coil that obviate the above occurrence.

However, to lower the peak voltage, it is necessary to reduce the inductance L1, to increase the value of the second resonance capacitor Cs, and to reduce the value of the first resonance capacitor C1. On the other hand, to lower the peak current, it is necessary to increase L1, to reduce Cs, and to increase C1. In this manner, the conditions for lowering the peak voltage and those for lowering the peak current are contradictory to each other, as well known in the art.

Moreover, the various factors mentioned above must satisfy the previously stated ZVS. It is therefore difficult to determine optimal factors by experiments or simple arithmetic operations.

Figure 8:
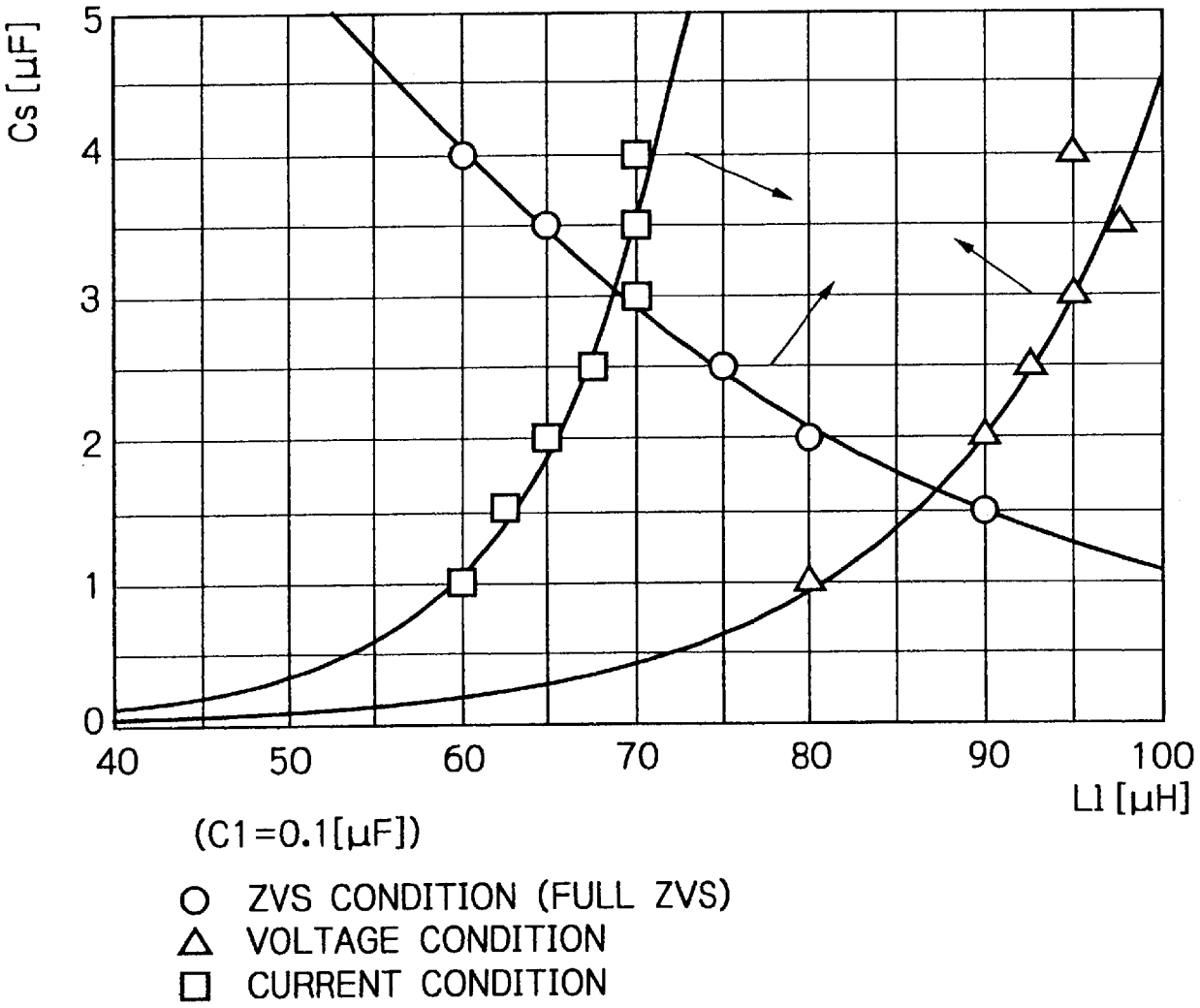
FIG. 8 is a graph demonstrating the operation of the present invention.

We therefore conducted simulations in a range implementing the optimal factors of the various elements under operating conditions that satisfy ZVS. Specifically, the simulations were conducted with a switching voltage of 700 V or below and a switching current of 700 A or below, which are customary with a switching device, for use in a fixing device belonging to the class concerned. Such a switching voltage and switching current are, however, only illustrative. FIG. 8 shows the results of simulations. In FIG. 8, Cs and L1 are varied with respect to C1 of 0.1 μF. A curve with circles is representative of the ZVS condition while a curve with squares is representative of a current condition. Further, a curve with triangles is representative of a voltage condition. In a range indicated by arrows in FIG. 8, the factors satisfy all of the required conditions.

Specifically, as FIG. 8 indicates, when capacitance of the first resonance capacitor C1 is 0.1 μF, the optimal factor of the work coil L1 is 70 μH to 100 μH while the optimal factor of the second resonance capacitor Cs is 1.8 μF to 5 μF.

Figure 9:
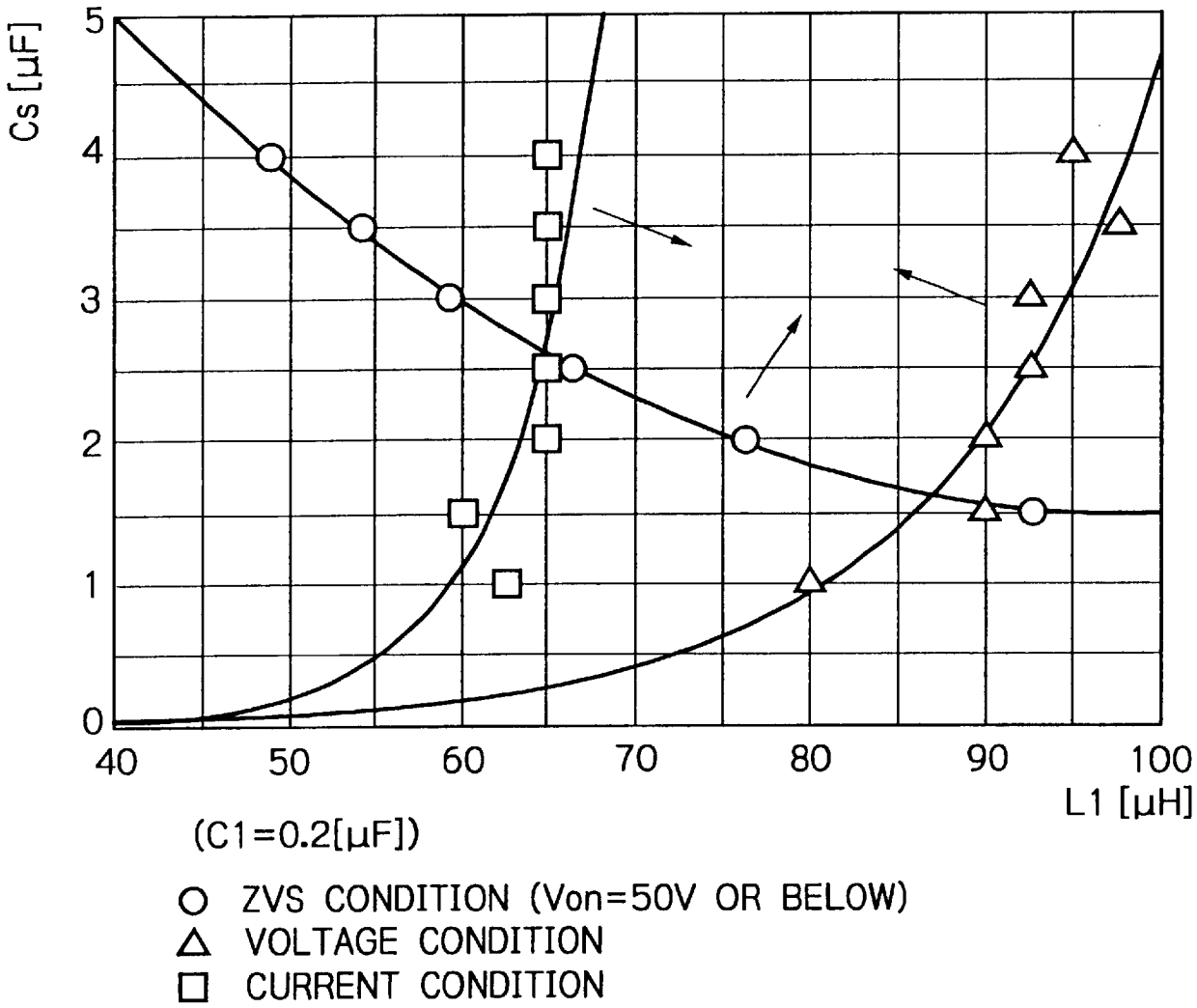
FIG. 9 is a graph demonstrating the operation of the present invention derived from alternative device factors.

Likewise, FIG. 9 shows the result of simulation conducted by varying the factor of the second resonance capacitor Cs and that of the work coil L1 for the capacitance of 0.2 μF of the first resonance capacitor C1. In a range indicated by arrows in FIG. 9, the factors satisfy all of the required conditions. Specifically, for the capacitance of 0.2 μF of the first resonance capacitor C1, the optimal factor of the work coil L1 is between 65 μH and 100 μH while the factor of the second resonance capacitor Cs is between 1.8 μF and 5 μF.

Figure 10:
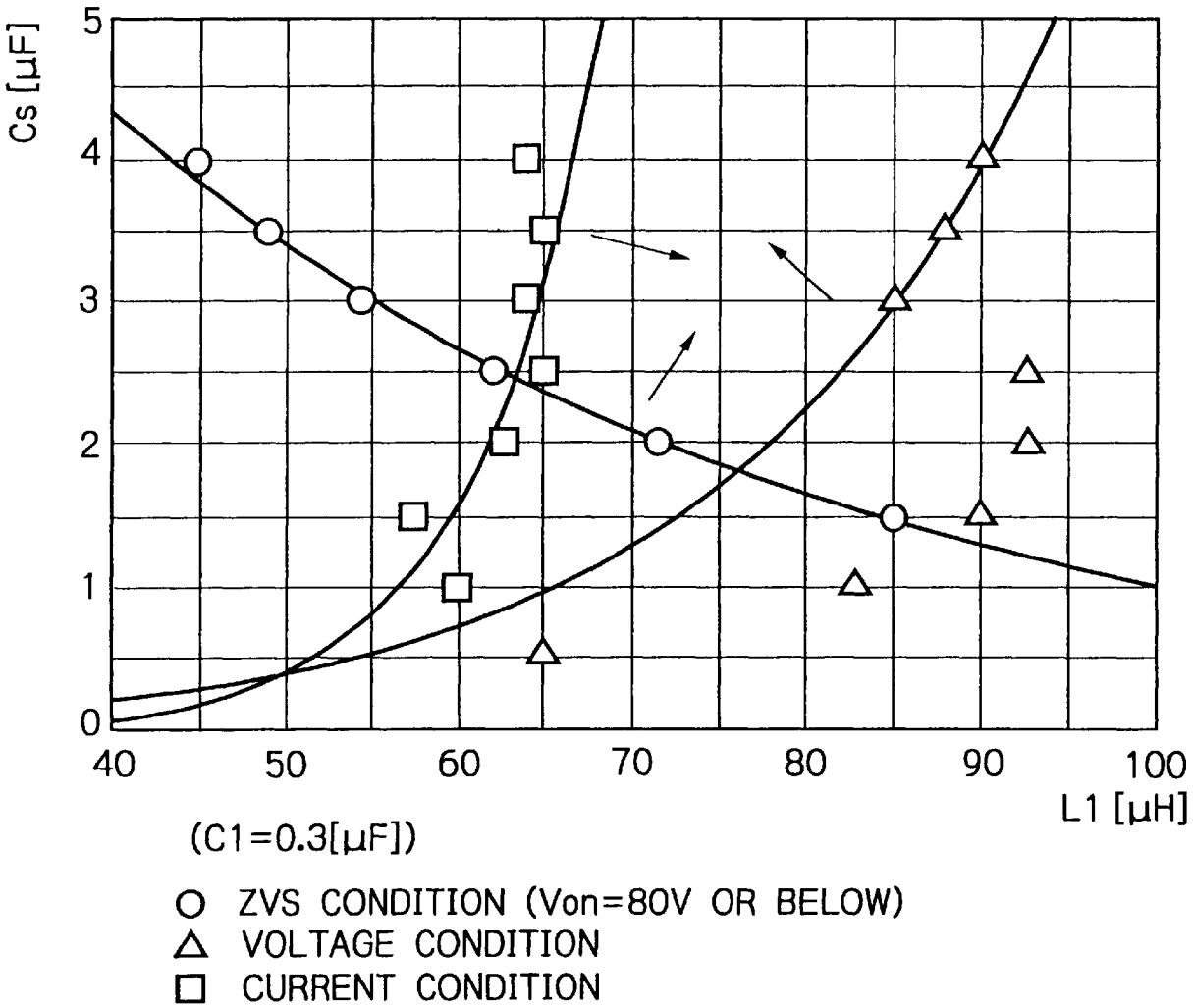
FIG. 10 is a graph demonstrating the operation of the present invention derived from other device factors.

Further, FIG. 10 shows the result of simulation conducted by varying the factor of the second resonance capacitor Cs and that of the work coil L1 for the capacitance of 0.3 μF of the first resonance capacitor C1. In a range indicated by arrows in FIG. 9, the factors satisfy all of the required conditions. Specifically, for the capacitance of 0.3 μF of the first resonance capacitor C1, the optimal factor of the work coil L1 is between 65 μH and 95 μH while the factor of the second resonance capacitor Cs is between 2 μF and 5 μF.

Figure 11:
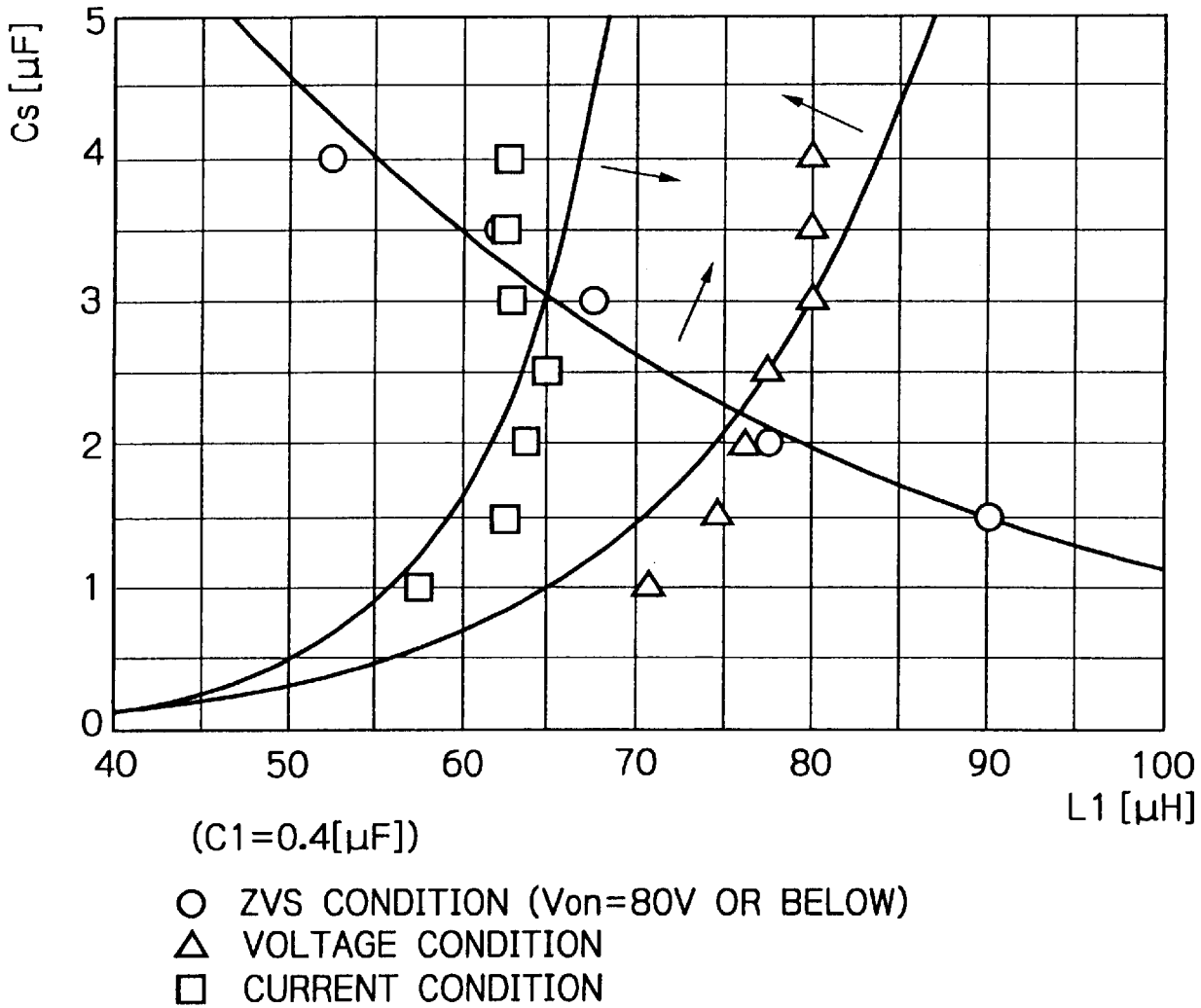
FIG. 11 is a graph demonstrating the operation of the illustrative embodiment derived other device factors.

Furthermore, FIG. 11 shows the result of simulation conducted by varying the factor of the second resonance capacitor Cs and that of the work coil L1 for the capacitance of 0.4 μF of the first resonance capacitor C1. In a range indicated by arrows in FIG. 9, the factors satisfy all of the required conditions. Specifically, for the capacitance of 0.4 μF of the first resonance capacitor C1, the optimal factor of the work coil L1 is between 65 μH and 87 μH while the factor of the second resonance capacitor Cs is between 2.3 μF and 5 μF.

The ranges of the factors are determined in the manner described in order to select optimal devices. This realizes a miniature fixing unit that allows its inverter to operate with optimal efficiency. While the capacitance of the first resonance capacitor C1 was selected to be 0.1 μF to 0.4 μF for simulation, such a range is substantially optimal from the inverter operation standpoint.

In summary, it will be seen that the present invention provides a fixing device that allows its inverter for induction heating to operate with optimal efficiency in the event of PWM power control. Also, the fixing device allows a resonance initial current value to be increased to broaden a ZVS range. Further, the fixing device enhances efficiency while preserving a broad control range, and reduces high frequency, switching noise.

Various modifications will become possible for those skilled in the art after receiving the teachings of the present disclosure without departing from the scope thereof.

What is claimed is:

1. A fixing device comprising:

an inverter circuit for induction heating, the inverter circuit comprising:

a first switching device that drives one end of an induction heating coil the other end of which is connected to a power source;

a first capacitor and a second switching device serially connected to each other and connected to opposite ends of the induction heating coil in parallel such that one end of said first capacitor is connected to the power source; and a second capacitor connected to said second switching device in parallel;

wherein said second capacitor has a capacitance of 0.1 μF, said induction heating coil has an inductance of 70 μH to 100 μH, and said first capacitor has a capacitance of 1.8 μF to 5 μF.

2. A fixing device comprising:

an inverter circuit for induction heating, the inverter circuit comprising:

a first switching device that drives one end of an induction heating coil the other end of which is connected to a power source;

a first capacitor and a second switching device serially connected to each other and connected to opposite ends of the induction heating coil in parallel such that one end of said first capacitor is connected to the power source; and a second capacitor connected to said second switching device in parallel;

wherein said second capacitor has a capacitance of 0.2 μF, said induction heating coil has an inductance of 65 μH to 100 μH, and said first capacitor has a capacitance of 1.8 μF to 5 μF.

3. A fixing device comprising:

an inverter circuit for induction heating, the inverter circuit comprising:

a first switching device that drives one end of an induction heating coil the other end of which is connected to a power source;

a first capacitor and a second switching device serially connected to each other and connected to opposite ends of the induction heating coil in parallel such that one end of said first capacitor is connected to the power source; and a second capacitor connected to said second switching device in parallel;

wherein said second capacitor has a capacitance of 0.3 μF, said induction heating coil has an inductance of 65 μH to 95 μH, and said first capacitor has a capacitance of 2 μF to 5 μF.

4. A fixing device comprising:

an inverter circuit for induction heating, the inverter circuit comprising:

a first switching device that drives one end of an induction heating coil the other end of which is connected to a power source;

a first capacitor and a second switching device serially connected to each other and connected to opposite ends of the induction heating coil in parallel such that one end of said first capacitor is connected to the power source; and a second capacitor connected to said second switching device in parallel;

wherein said second capacitor has a capacitance of 0.4 $\mu$F, said induction heating coil has an inductance of 65 $\mu$H to 87 $\mu$H, and said first capacitor has a capacitance of 2.3 $\mu$F to 5 $\mu$F.

* * * * *